United States Patent [19]

La Barge

[11] Patent Number: 4,982,862

[45] Date of Patent: Jan. 8, 1991

[54] DIGITALLY OPENABLE, RESEALABLE CONTAINER CLOSURE

[75] Inventor: Robert L. La Barge, Pittsburgh, Pa.

[73] Assignee: Aluminum Company of America, Pittsburgh, Pa.

[21] Appl. No.: 338,310

[22] Filed: Apr. 14, 1989

[51] Int. Cl.[5] ..... B65D 17/44

[52] U.S. Cl. ..... 220/278; 220/258; 220/268; 215/230

[58] Field of Search ..... 220/254, 258, 265, 268, 220/266, 277, 278; 215/226, 301

[56] References Cited

U.S. PATENT DOCUMENTS

| | | | |
|---|---|---|---|
| 3,807,597 | 4/1974 | Wells et al. . | |
| 3,902,626 | 9/1975 | Jordan et al. | 220/268 |
| 3,912,114 | 10/1975 | Morran et al. | 220/268 |
| 3,913,782 | 10/1975 | Cass | 220/260 |
| 3,924,777 | 12/1975 | Peyser | 220/277 |
| 3,929,251 | 12/1975 | Urmston | 220/268 |
| 3,931,905 | 1/1976 | Shumway et al. | 220/278 |
| 3,938,455 | 2/1976 | Urmston . | |
| 3,938,693 | 2/1976 | Patel et al. | 220/277 X |
| 3,946,683 | 3/1976 | Jordan . | |
| 3,977,341 | 8/1976 | Jordan et al. . | |
| 3,997,076 | 12/1976 | Jordan | 220/268 |
| 4,024,981 | 5/1977 | Brown | 220/269 |
| 4,039,101 | 8/1977 | Wells | 220/269 |
| 4,148,410 | 4/1979 | Brown | 220/269 |
| 4,434,906 | 3/1984 | Florczyk et al. | 220/268 |
| 4,580,692 | 4/1986 | La Barge et al. | 220/240 |
| 4,648,528 | 3/1987 | La Barge et al. | 220/240 |
| 4,673,099 | 6/1987 | Wells | 220/269 |
| 4,678,096 | 7/1987 | La Barge et al. | 220/273 |
| 4,685,849 | 8/1987 | La Barge et al. | 413/22 |
| 4,783,985 | 11/1988 | La Barge et al. | 72/379 |
| 4,793,510 | 12/1988 | Arfert et al. | 220/306 |

*Primary Examiner*—Stephen Marcus
*Assistant Examiner*—Nova Stucker
*Attorney, Agent, or Firm*—David W. Brownlee; Robert E. Isner

[57] ABSTRACT

This invention relates to an improved can end construction for carbonated beverage cans having a score line defined opening panel therein for beverage dispensing and, more particularly, to can ends for such type cans wherein said panel is incorporated in a selectively contoured spout configuration for accommodation of a resealing cap assembly engageable therewith.

20 Claims, 3 Drawing Sheets

DIGITALLY OPENABLE, RESEALABLE CONTAINER CLOSURE

BACKGROUND OF THE INVENTION

Recent years have witnessed ever increasing quantities of carbonated beverages, such as beer and carbonated soft drinks, being packaged in amounts of up to 12 ounces in metal cans and particularly in metal cans with ends that include a score line defined opening panel therein to provide implement free access to the contents. Such opening panel containing can ends are generally called "easy open ends" and include variant basic constructions of a first type wherein the score line completely circumscribes the panel to render the panel completely separable from the can end and of a second type wherein the score line only partially circumscribes the panel to render the latter only partially severable from the can end and to thus remain in attached relation within the can after the pouring opening has been formed. Among the variant constructions of the second type are those that include a manually displaceable lever member to fracture the score line and to pivotally displace the hinged opening panel to a location within the can body, as exemplified by U.S. Pat. Nos. 4,024,981 and 4,148,410. Such variant constructions of the second type also include can ends in which the lever member is dispensed with and score line fracture and panel displacement is initiated by application of direct finger pressure on, or adjacent to, the score line, as exemplified by U.S. Pat. Nos. 3,929,251, 3,997,076 and 3,977,341. As mentioned above, all such opening panels are conventionally perimetrically delineated by score lines of decreased metal thickness.

In order to extend the use of such easy open can end constructions to larger volume containers, the art has suggested the utilization of a cap assembly to close and reseal the opening defined by such score line defined panel. Among the objects of such cap utilization are a re-closure of the container to prevent loss of liquid content and a resealing of the container to limit further losses of the dissociable gases, i.e., the "carbonation", in the remaining liquid content. U.S. Pat. No. 4,580,692 discloses one construction for such a resealable closure cap assembly in association with a selectively contoured can end construction to cooperatively accommodate such resealable closure and to retain the advantages characteristic of the "easy open end" constructions.

The provision of commercially acceptable resealable easy open can end constructions for larger capacity beverage containers requires both sealable retention of the can contents and accommodation of the inherent pressure buildup therein. Also required is a can end configuration at the pouring opening that dispenses with any lever mechanisms or the like and which is easily and readily opened by the user by mere application of finger pressure in a simple and non-hazardous manner, all without diminution of the convenience and cost effective nature of the basic easy open end constructions during manufacturing, filling, shipping, selling, and consumer usage thereof. As such, the provision of a commercially acceptable lever-free resealable easy open end construction requires accommodation of problems not heretofore met in the basic easy open end constructions conventionally employed in the smaller capacity beverage cans.

Experience to date with the resealable cap and can end construction disclosed in U.S. Pat. Nos. 4,580,692 and 4,648,528, the disclosure contents of which are herein generally incorporated by reference, has indicated that difficulties have been encountered by some users in both effecting optimum location of the point of finger pressure application relative to the score line defined opening panel and in the undue amounts of digital pressure required for effecting score line fracture and panel displacement particularly when such finger pressure is applied at locations other than the desired optimum location therefore.

SUMMARY OF THE INVENTION

This invention may be briefly described as an improved easy open can end construction that includes means to insure optimum location of the sealing cap relative to the score line defined opening panel preparatory to application of sufficient digital pressure thereon to initiate score line fracture and consequent displacement of the opening panel inwardly of the container in association with unit pressure amplification and a score line configuration that cooperatively markedly reduces the opening forces required to initiate fracture of the score line. In its broader aspects the invention includes the provision of a downwardly projecting pointed boss on the underside of a displaceable sealing cap in association with a dome shaped opening panel defined by a score line and an adjacent outboard abutment adapted to optimally position said pointed boss relative to said score line to permit application of enhanced unit pressure thereto to initiate score line fracture. In another broad aspect, the subject invention includes the provision of a score line perimetrically defining an opening panel and a surrounding continuous lip with the upper surface of the portion of the opening panel adjacent to the score line being disposed substantially coplanar with the undersurface of the portion of the lip adjacent to the score line to induce substantially pure shear stress induced fracture of said score line. In another aspect, the invention includes the utilization of a reduced residual thickness of the score line at the situs of fracture inducing pressure application thereto and the prestressing of such score line in the vicinity of the point of pressure application to substantially 100% of its shear yield strength. In still other aspects the invention includes the provision of readily visible polygonal indicia on the upper surface of the sealing cap in predetermined spatial relation with the apex of the downwardly projecting boss to identify the desired locus of digital pressure thereon to initiate fracture of the opening panel defining score line. In a further aspect the invention includes the provision of complemental contours for the apex of said pointed boss and the surface of the score line defined opening panel engageable thereby to effect optimal positional disposition of the apex of said boss relative to said score line during application of initial downward digital pressure on the upper surface of the sealing cap and prior to pressure induced fracture thereof.

Among the advantages of the subject invention is the provision of an improved construction for resealable easy open can ends requiring markedly decreased opening forces, readily obtainable optimal location of the point of application of such opening forces, simplicity and reliability of digital operation, and a high stability of the container during opening. A further advantage is the provision of amplified unit pressures for initiating fracture of a score line defining an opening panel in association with an effectively automatic selective location of said amplified unit pressures at an optimal location for the application thereof in a resealable easy open can end construction. Still other advantages include the provision of a score line fracturable through application of substantially pure shear stress thereto and the selective prestressing of said score line to the vicinity of its shear yield strength to reduce the magnitude of applied opening force required to initiate score line fracture. Still another advantage is the provision of readily visible indicia on the upper surface of the sealing cap identifying the situs of digital pressure application thereto.

The object of this invention is the provision of an improved construction for resealable easy open can ends that reduces the force required to initiate fracture of a score line defining an opening panel therein and that simplifies the opening of such type can by application of digital pressure thereto.

A further object of this invention is the provision of an improved construction for resealable easy open can ends that optimally positions the point of pressure application relative to the opening panel defining score line during the initial application of digital opening pressure to a resealing cap.

A further object of this invention is the provision of an improved construction for resealable easy open can ends and particularly for the resealable easy open can end construction disclosed in U.S. Pat. Nos. 4,580,692 and 4,648,528.

Other objects and advantages of the invention will become apparent from the following portions of this specification and from the appended drawings which illustrate, in accord with the mandate of the patent statutes, a presently preferred embodiment of a can end construction that incorporates the principles of this invention.

DETAILED DESCRIPTION OF THE INVENTION

As pointed out above, the invention herein will be described in association with a resealable easy open end construction of the type generally disclosed in U.S. Pat. Nos. 4,580,692 and 4,648,528, the disclosure contents of which are incorporated by reference. However it should be understood that the invention may be used in other easy open end can constructions.

Where the words "upwardly", "inward", "outwardly", "under", "underside", "downwardly" and the like are used hereinafter, their meaning is to be taken with reference to a can in an upright position having a can end incorporating this invention attached to the top end thereof.

Figure 1:
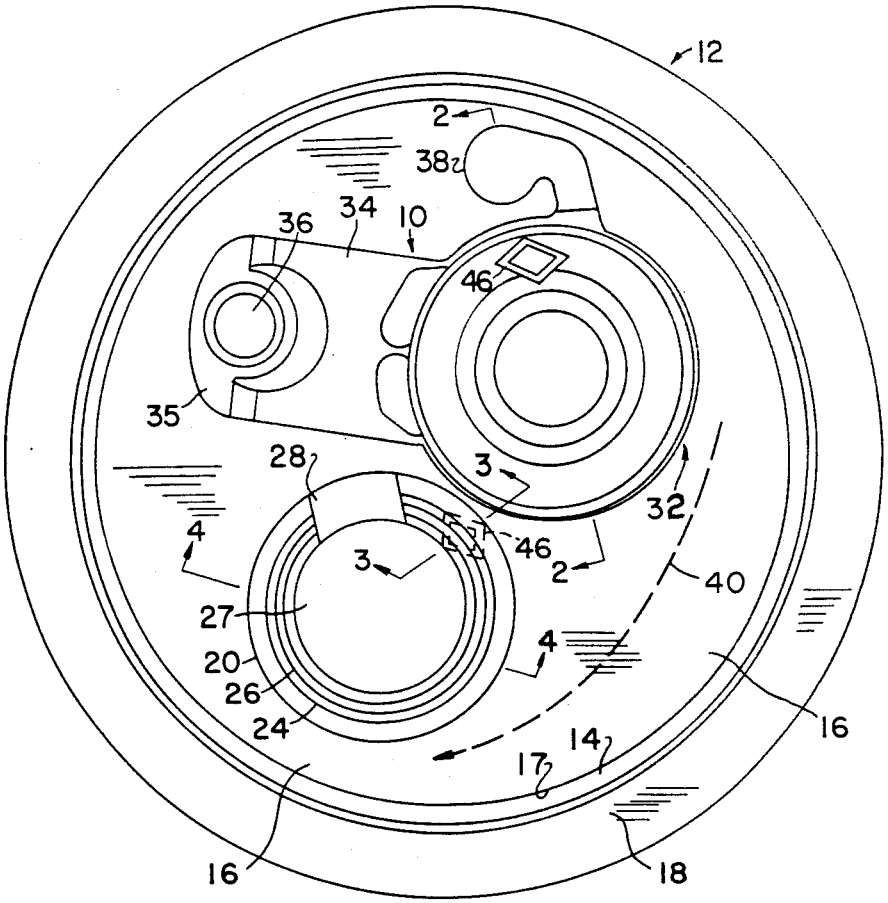
FIG. 1 is a plan view of an easy open can end construction as modified to incorporate the principles of this invention.

Referring to the drawings, and initially to FIG. 1, the improved can end construction incorporating the principles of this invention is disclosed in association with a can end closure 12 prior to the can end closure's engagement with a can body by double seaming. Such can end closure 12 includes a substantially flat or planar end wall portion 16, a countersink defining inner sidewall 17 and an outer sidewall 14 terminating in an upwardly and outwardly projecting annular flange 18 forming a chime for conventional attachment of the can end to a can body by double seaming.

Figure 4:
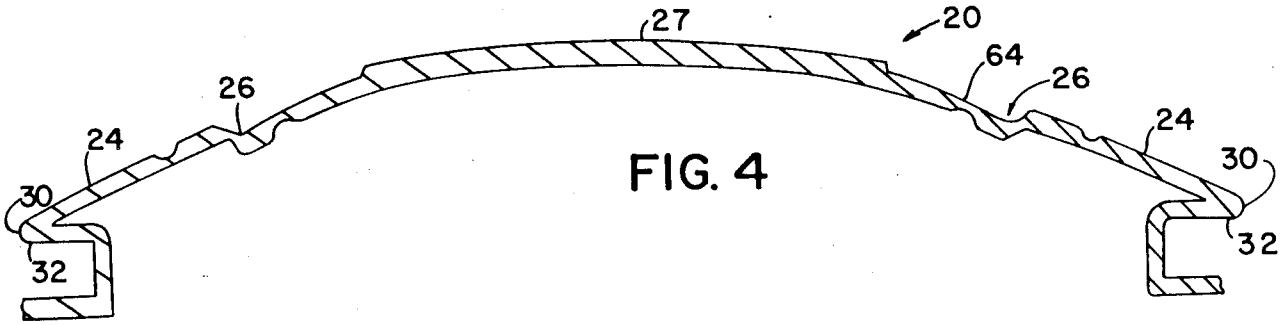
FIG. 4 is a sectional view as taken on the line 4—4 of FIG. 1.

As best shown in FIGS. 1 and 4, the can end closure 12 further includes an upwardly projecting dispensing spout 20, suitably of circular configuration and formed as an integral portion thereof. Such spout 20 includes an upwardly domed upper surface having thereon a score line 26, interrupted by a hinge 28, partially circumscribing and defining an opening panel 27 depressable inwardly of the can by fracture of the score line. Such opening panel 27 and defining score line 26 is surrounded by a continuous lip 24 having substantially smooth sealing surfaces 30 and 32 and which upper surface forms a peripheral continuity of said upwardly domed surface. Associated with the dispensing spout 20 is a resealing cap assembly 10, preferably molded in one piece of a resinous or plastic material having a low modulus of elasticity, such as, for example, low density polyethylene. The resealing cap assembly 10 includes a sealing cap portion 34 adapted to be placed in sealing relation over the spout 20 and the score line defining opening panel 27 therein, and a tab 38 projecting outwardly from the sealing cap portion 32 for convenience in manipulation of the cap. The cap assembly 10 is pivotally attached to the end wall 16 by means of a rivet 36 extending through an appropriate opening in a boss 35. The outboard edge of the flange of the rivet 36 is formed downwardly a controlled amount when the rivet is staked to securely attach the cap assembly to the can end, but also to permit the sealing cap portion 32 to be rotated by hand about the rivet 36 with relative ease as indicated by the dotted line 40. Preferably, the rivet 36 is an integrally formed portion of the end wall 16.

As shown in FIG. 1 the sealing cap 32 is adapted to be pivotally displaced about the rivet 36 from a first location remote from the pouring spout 20, to a second location in overlying relation with the domed upper surface of the spout 20 prior to a digitally initiated fracture of the score line 26 therein. Disposed at a predetermined location on the upper surface of the sealing cap 32 is a clearly visible pressure point location indicia 46 of polygonal configuration, preferably of rhomboid character, having an included angle of about 70°, that serves to provide for maxim visibility within the limited space available. Desirably such pressure point location indicia 46 is molded on the cap surface and, as will be hereinafter further explained, is located in radial alignment with and above a selectively shaped and located, downwardly projecting boss 50 on the undersurface of the cap 32.

Figure 2:
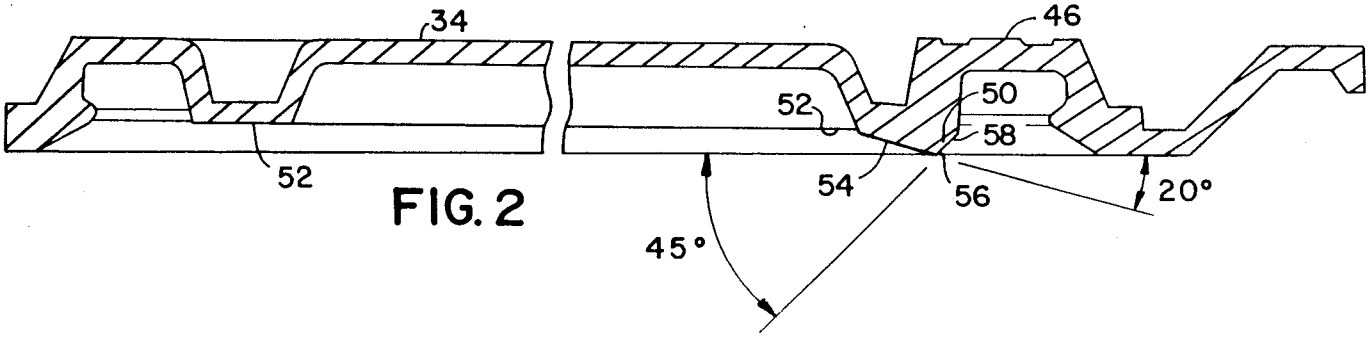
FIG. 2 is a sectional view of the sealing cap as taken on the line 2—2 of FIG. 1.
Figure 3:
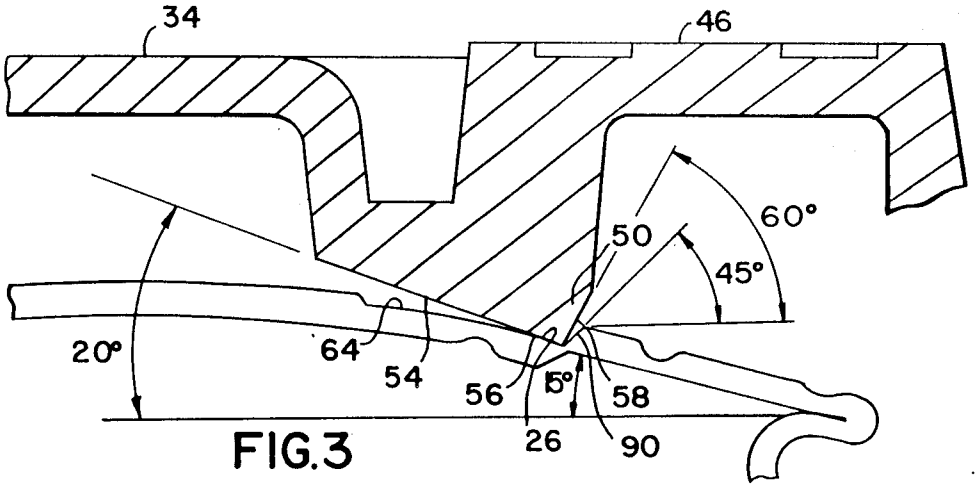
FIG. 3 is a sectional view on an enlarged scale and as taken on the line 3—3 of FIG. 1 when the resealing cap is disposed in superposed overlying relation with the pouring spout assembly preparatory to rupture of the score line to form the pouring opening therein.

As best shown in FIGS. 2 and 3, the boss 50 is suitably in the nature of a downwardly projecting extension, desirably of generally circular configuration, at a predetermined location on the annular bottom wall 52. In the illustrated preferred construction such boss 50 includes an upwardly sloping base portion 54 disposed at an angle upward from the apex 56 toward the center of the cap, suitably about 20°, and greater than the angle of the domed upper surface of the spout 20, the later being suitably about 15°. As shown, such divergence of angular disposition operates to inure that contact with top of the spout 20 will occur only at the apex 56. Cooperatively associated therewith is an outboard upwardly sloping surface 58 disposed at an angle relative to the horizontal much greater than that of the angle of the surface 54, for reasons that will hereinafter be pointed out. As will be apparent the apex 56 of the boss 50 will be of essentially point or line character with an attendant minimal area of contact to enhance and magnify the unit pressures at the point of contact thereof with the can top during opening operations effected by downward digital pressure.

As previously pointed out, the boss 50 is located at a predetermined location on the circumference of the annular bottom wall 52 that is operative to satisfy a number of practical criteria. One of such criteria is to maximize can stability during initial opening and during resealing operations where, in contradistinction to the lever type opening systems, a downward pushing force is here required rather than an upward pulling force. In the herein disclosed lever free type of unit, the downwardly directed opening forces should be applied as close to the center of the can as practicable. In addition, for optimum opening characteristics, the point of initial score line fracture should be at least about 30° away from the hinge 28, and for optimum pouring after the panel 27 has been displaced into the container the hinge 28 should desirably be located in the vicinity of the center of the can end. In the illustrated embodiment the desired location of the point of pressure application to initiate score line fracture is a compromise of these somewhat antithetical criteria so the point of pressure application is about 50° from the hinge 28 and relatively close to the center of the can end.

Figure 6:
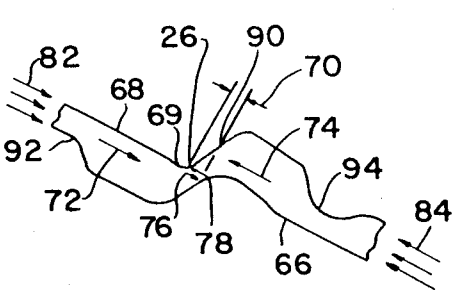
FIG. 6 is a further enlarged sectional view further depicting the mechanics of score line fracture.
Figure 5:
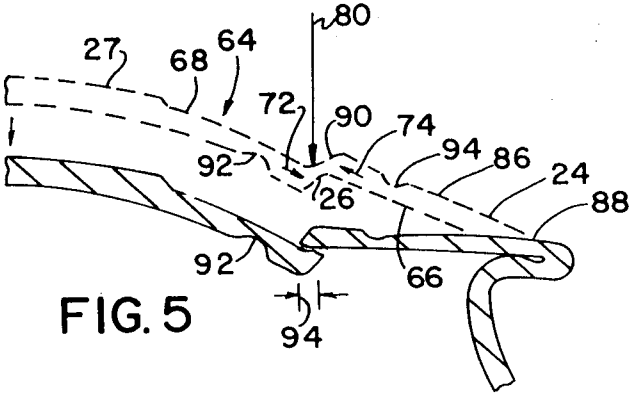
FIG. 5 is an enlarged sectional view of a portion of FIG. 3 depicting the mechanics of score line fracture.

Cooperatively associated with the above described and depicted unit pressure magnifying downwardly projecting boss 50 and overlying pressure point location indicia 46 on the upper surface of the cap 34 is a selectively contoured score line configuration that permits markedly reduced opening forces to be applied thereto to effect initiation of score line fracture during the opening of the can. Referring now to FIGS. 4 to 6, and as previously pointed out, the upper surface of the spout 20 includes an upwardly domed opening panel 27 perimetrically defined by a score line 26 and surrounded by a continuous lip 24. The angle of inclination of said continuous lip 24 and the inwardly adjacent portions of the domed opening panel is desirably about 15° relative to the horizontal. The marginal edge of the domed opening panel 27, at least in the immediate vicinity of the desired locus of pressure application, is of reduced thickness forming a shallow recess 64 adjacent to the score line 26. More importantly, the undersurface 66 of the lip 24 is disposed coplanar with or slightly above the upper surface 68 of the recess 64 in the domed opening panel 27 which operates to facilitate definition of a reduced score line residual 70 (see FIG. 6) and which insures that when a downwardly directed opening force 80 (see FIG. 5) is applied, the toggle action that produces forces 72 and 74 in the sections of the panel 27 and lip 24 on either side of the score line stress the score residual 70 in essentially pure shear, as indicated by the arrows 76 and 78 in FIG. 6. Such resultant stressing of the score line 26 in essentially pure shear, in contrast to stressing it in tension or compression, will approximately halve the force required to initiate score line rupture, since the shear strength of can end stock is generally about one half of its compressive or tensile strength.

In addition to the foregoing, the required force 80 to initiate fracture of the score line 26 can be further markedly reduced by having the residual compressive stresses 82 and 84, as indicated by the arrows in FIG. 6, from the forming operation at a magnitude that produces stresses in the score residual 70 that are a substantial portion of the shear yield strength. The residual stresses 82 and 84 act parallel to and in the same direction respectively as the stresses 72 and 74 produced by the opening force 80 thereby reducing the level of forces 72 and 74 that are required to initiate rupture and, more importantly, reduce the level of opening force 80 that is required to produce the reduced forces 72 and 74. This prestress condition also greatly further reduces the amount of horizontal toggle action required to rupture the score line and permits the use of a smaller angle (15°) of inclination for the domed top of the spout having a greater mechanical advantage to further reduce the opening force 80. As a further advantage, internal pressures normally present in an unopened can produce stresses opposite to residual stresses 82 and 84, therefore residual stresses 82 and 84 provide the additional benefit of increasing the resistance of the score line to fracture induced by excessive internal pressure, because score fracture due to internal pressure requires that the score line be loaded past its ultimate shear strength in a direction opposite to that applied by the residual stresses 82 and 84.

The above described disposition of the undersurface 66 of the lip 24 as being located coplanar with or slightly above the upper surface 68 of the recess 64 in the domed opening panel 27, in addition to providing for substantially shear stress induced initial fracture of the score line, also serves to selectively position the downwardly dependent boss 50 on the underside of the cap 34 in optimal location for pressure application. As shown in FIGS. 3 through 6, such positional relationship between surfaces 66 and 68 also produces an abutment 90 outward of and closely adjacent to the score line 26. As shown in FIGS. 1 and 3, when the sealing cap 34 is pivotally displaced into general overlying relation with the spout 20 the apex 56 of the boss 50 will be disposed somewhere in the recess 64. Because of the previously described angular divergence between the inclined undersurface 54 (e.g., about 20°) and the slope (e.g., about 15°) of the domed panel 27, contact will only occur at the apex 56. Apex 56 will most probably contact the upper surface 68 of the recess 64 somewhere inwardly of the score line and the initial downward pressure 80 on the indicia 46 will cause the apex 56 to slide down the dome until such apex reaches the score line 26 when its sliding motion will be stopped by the abutment 90. This permitted sliding displacement reduces the criticality of initial positioning of the sealing cap 34 over the spout 20 and further produces a positive "feeling right" position to the user when the boss is positioned in optimal location for application of the opening forces to the score line 26. When the above described preferred opening technique is used, the boss 50 and the fracture indicia 46 confine the point of fracture initiation to a precise area. This permits a further reduction in the score width 70 over a small length (approximately 5%) of the score line at this precise area to reduce the force required to initiate opening fracture with an insignificant reduction in the resistance of the score to fracture induced by internal pressure. This is because the force required for an opening-induced fracture is a function of the local strength of the score line while the force required for a pressure-induced fracture is a function of the overall strength of the score; therefore, reducing the score width by about 25% over 5% of its length will reduce the overall strength of the score by only 1.3%. Since the force required to initiate fracture is the maximum force in the opening process, reducing the score width locally produces significant reduction in the opening force with essentially no reduction in internal pressure resistance.

The low strength of the above described score line configuration and relative to the very high stresses that it is subjected to during the forming operations make it desirable to utilize both inboard 92 and outboard 94 anti-fracture scores. Such anti-fracture scores protect the score line 26 from being pulled apart by the tooling forces during the formation of the score residual 70 and, in addition, control the level of residual stress that remains after score line formation. Anti-fracture scores having a depth of approximately 50% of the metal thickness at their site provide the preferred residual stress level while preventing fracture.

Having thus described my invention, I claim:

1. In a sheet metal end closure assembly for a container that includes a generally planar wall portion having a peripheral chime for securement to a container body, a score line perimetrically defining an inwardly displaceable opening panel for forming an opening to permit dispensing of the container contents therethrough, a continuous lip having a substantially smooth sealing surface thereon surrounding said score line defined opening panel, a sealing cap having a perimetric surface contoured for a gas tight interfacial sealing relationship with said continuous lip and displaceable intermediate a first location remote from said score line defined opening panel to a second location disposed in generally overlying relation with said continuous lip, the improvement comprising the opening panel and the surrounding contiguous surface of said continuous lip being of upwardly domed configuration and selectively contoured to position the undersurface of the portion of said continuous lip disposed closely adjacent to said score line substantially coplanar with the upper surface of said opening panel disposed closely adjacent to said score line to form an upwardly directed inwardly facing perimetric abutment adjacent to said score line for insuring selective exposure of said score line to substantially pure fracture inducing shear stresses in response to a downwardly directed opening force applied to said opening panel closely adjacent to said score line.

2. The combination as set forth in claim 1 wherein said sealing cap includes a downwardly projecting pointed boss on the undersurface thereof adapted to be positioned in interfacial relation with said abutment in response to downward digital pressure applied to the upper surface of said sealing cap for selective application of amplified fracture inducing unit pressures of said opening panel closely adjacent to said score line to initiate fracture thereof.

3. The combination as set forth in claim 1 wherein said opening panel and surrounding continuous lip are part of an upwardly projecting spout assembly.

4. The combination as set forth in claim 1 wherein said sealing cap is pivotally mounted on said planar wall portion.

5. The combination as set forth in claim 1 wherein the thickness of the opening panel and the portion of said continuous lip disposed in contiguous relation with said score line are of lesser thickness than the metal forming the center portion of said opening panel.

6. The combination as set forth in claim 1 wherein the portion of said continuous lip peripherally surrounding said opening panel is upwardly inclined toward the center of the opening panel at an angle of about 15° to the horizontal.

7. The combination as set forth in claim 2 wherein said sealing cap includes a readily visible indicia on the upper surface thereof above and in radial alignment with the apex of said downwardly projecting boss to identify the desired locus of digital pressure thereon to effect fracture of said score line.

8. The combination as set forth in claim 2 wherein said abutment is inclined in a range of about 30° to 45° relative to the horizontal.

9. The combination as set forth in claim 2 wherein the apex of said downwardly projecting pointed boss is formed by the intersection of a first surface adapted to face said abutment that is inclined in a range of about 45° to 60° to the horizontal and a second surface adapted to face the surface of said opening panel that is inclined about 20° to the horizontal.

10. The combination as set forth in claim 1 further including an anti-fracture score line in the upper surface of said continuous lip disposed in spaced concentric relation with said first mentioned opening panel defining score line.

11. The combination as set forth in claim 10 including a second anti-fracture score line in the undersurface of said opening panel disposed in spaced concentric relation with said first mentioned opening panel defining score line.

12. The combination as set forth in claim 11 wherein the thickness of the metal at said anti-fracture score lines is about 50% of the metal thickness disposed on either side thereof.

13. The combination as set forth in claim 1 wherein the score line is prestressed to substantially 100% of its shear yield strength.

14. The combination as set forth in claim 7 wherein said pressure application indicia is of polygonal configuration.

15. The combination as set forth in claim 14 wherein said pressure application indicia is of rhomboid configuration.

16. In a sheet metal end closure assembly for a container that includes a generally planar wall portion having a peripheral chime for securement to a container body, a score line perimetrically defining an inwardly displaceable hinged opening panel for forming an opening to permit dispensing of the container contents therethrough, a continuous lip having a substantially smooth sealing surface thereon surrounding said score line defined opening panel, a sealing cap having a perimetric surface contoured for a gas tight interfacial sealing relationship with said continuous lip and pivotally displaceable intermediate a first location remote from said score line opening panel to a second location disposed in generally overlying relation with said continuous lip, the improvement comprising the opening panel and the surrounding contiguous surface of said continuous lip being of upwardly domed configuration and selectively contoured to position the undersurface of the portion of said continuous lip disposed closely adjacent to said score line substantially coplanar with the upper surface of said opening panel disposed closely adjacent to said score line to form an upwardly directed inwardly facing perimetric abutment inclined in a range of about 30° to 45° to the horizontal externally adjacent to said score line, said score line including a segment of reduced width at a predetermined location thereon, and said sealing cap including a downwardly projecting pointed boss on the undersurface thereof beneath and in radial alignment with a readily visible indicia on the upper surface thereof, said boss having an apex formed by the intersection of a first surface adapted to face said abutment and inclined in a range of about 45° to 60° to the horizontal and a second surface adapted to face the surface of said opening panel and inclined at about 20° to the horizontal, said boss adapted to be optimally positioned in interfacial relation with said abutment and in overlying relation with said score line segment of reduced width in response to downward digital pressure applied to said indicia on the upper surface of said sealing cap when said cap is at its second location for selective application of amplified fracture inducing unit pressures to said reduced width segment of said score line to induce substantially pure fracture inducing shear stresses therein to initiate score line fracture.

17. The combination as set forth in claim 16 further including a first anti-fracture score line in the upper surface of said continuous lip disposed in spaced concentric relation with said first mentioned opening panel defining score line, a second anti-fracture score line in the undersurface of said opening panel disposed in spaced concentric relation with said first mentioned opening panel defining score line, and said first and second anti-fracture score lines being of a metal thickness of about 50% of the thickness of metal disposed on either side thereof.

18. The combination as set forth in claim 16 wherein the score line is prestressed to substantially 100% of its shear yield strength.

19. The combination as set forth in claim 16 wherein said indicia on the upper surface of said sealing cap is of rhomboid configuration.

20. The combination as set forth in claim 19 wherein the horizontal cross section of said downwardly projecting boss is circular and about 0.090" in diameter.

* * * * *